US006298673B1

(12) United States Patent
Fung et al.

(10) Patent No.: US 6,298,673 B1
(45) Date of Patent: Oct. 9, 2001

(54) METHOD OF OPERATING A REFRIGERATED MERCHANDISER SYSTEM

(75) Inventors: Kwok Kwong Fung, Granger, IN (US); Robert Hong Leung Chiang; Eugene Duane Daddis, Jr., both of Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/652,353

(22) Filed: Aug. 31, 2000

Related U.S. Application Data

(63) Continuation-in-part of application No. 09/573,308, filed on May 18, 2000.

(51) Int. Cl.[7] ..... F25D 21/12

(52) U.S. Cl. ..... 62/82; 62/282; 62/227

(58) Field of Search ..... 62/246, 217, 115, 62/82, 227, 282, 255, 256

(56) References Cited

U.S. PATENT DOCUMENTS 3,800,551 * 4/1974 Weibel, Jr. et al. ..... 62/224
4,644,758 * 2/1987 Maehara et al. ..... 62/256
5,743,098 * 4/1998 Behr ..... 62/255
5,799,728 * 9/1998 Blume ..... 62/282
5,832,995 * 11/1998 Chiang et al. ..... 165/179
6,076,368 * 6/2000 Noble ..... 62/255

* cited by examiner

*Primary Examiner*—William E. Tapolcal
*Assistant Examiner*—Mohammad M Ali
(74) *Attorney, Agent, or Firm*—William W. Habelt

(57) ABSTRACT

A refrigerated merchandiser system (10) includes a compressor (20), a condenser (30), a display case (100) having an evaporator (40), an expansion device (50), and an evaporator pressure control device (60) connected in a closed refrigerant circuit via refrigerant lines (12, 14, 16 and 18). The evaporator pressure control device (60) operates to maintain the pressure in the evaporator at a set point pressure so as to maintain the temperature of the refrigerant expanding from a liquid to a vapor within the evaporator (40) at a desired temperature. A controller (90) operatively associated with the evaporator pressure control device (60) maintains the set point pressure at a first pressure for the refrigerant equivalent to a first refrigerant temperature during a first refrigeration mode and at a second pressure for the refrigerant equivalent to a second refrigerant temperature about 2 to about 12 degrees warmer than the first temperature during a second refrigerant mode. The controller (90) sequences operation between said first refrigeration mode and said second refrigeration mode.

16 Claims, 2 Drawing Sheets

METHOD OF OPERATING A REFRIGERATED MERCHANDISER SYSTEM

REFERENCE TO RELATED APPLICATION

This application is a continuation-in-part of commonly assigned, co-pending application Ser. No. 09/573,308, filed May 18, 2000, for Refrigerated Merchandiser System.

TECHNICAL FIELD

The present invention relates generally to refrigerated merchandiser systems and, more particularly, to the operation of a refrigerated, medium temperature, food merchandiser system in a substantially frost-free mode.

BACKGROUND OF THE INVENTION

In conventional practice, supermarkets and convenient stores are equipped with display cases, which may be open or provided with doors, for presenting fresh food or beverages to customers, while maintaining the fresh food and beverages in a refrigerated environment. Typically, cold, moisture-bearing air is provided to the product display zone of each display case by passing air over the heat exchange surface of an evaporator coil disposed within the display case in a region separate from the product display zone so that the evaporator is out of customer view. A suitable refrigerant, such as for example R-404A refrigerant, is passed through the heat exchange tubes of the evaporator coil. As the refrigerant evaporates within the evaporator coil, heat is absorbed from the air passing over the evaporator so as to lower the temperature of the air.

A refrigeration system is installed in the supermarket and convenient store to provide refrigerant at the proper condition to the evaporator coils of the display cases within the facility. All refrigeration systems comprise at least the following components: a compressor, a condenser, at least one evaporator associated with a display case, a thermostatic expansion valve, and appropriate refrigerant lines connecting these devices in a closed circulation circuit. The thermostatic expansion valve is disposed in the refrigerant line upstream with respect to refrigerant flow of the inlet to the evaporator for expanding liquid refrigerant. The expansion valve functions to meter and expand the liquid refrigerant to a desired lower pressure, selected for the particular refrigerant, prior to entering the evaporator. As a result of this expansion, the temperature of the liquid refrigerant also drops significantly. The low pressure, low temperature liquid evaporates as it absorbs heat in passing through the evaporator tubes from the air passing over the surface of the evaporator. Typically, supermarket and grocery store refrigeration systems include multiple evaporators disposed in multiple display cases, an assembly of a plurality of compressors, termed a compressor rack, and one or more condensers.

Additionally, in certain refrigeration systems, an evaporator pressure regulator (EPR) valve is disposed in the refrigerant line at the outlet of the evaporator. The EPR valve functions to maintain the pressure within the evaporator above a predetermined pressure set point for the particular refrigerant being used. In refrigeration systems used to chill water, it is known to set the EPR valve so as to maintain the refrigerant within the evaporator above the freezing point of water. For example, in a water chilling refrigeration system using R-12 as refrigerant, the EPR valve may be set at a pressure set point of 32 psig (pounds per square inch, gage) which equates to a refrigerant temperature of 34 degrees F.

In conventional practice, evaporators in refrigerated food display systems generally operate with refrigerant temperatures below the frost point of water. Thus, frost will form on the evaporators during operation as moisture in the cooling air passing over the evaporator surface comes in contact with the evaporator surface. In medium-temperature refrigeration display cases, such as those commonly used for displaying produce, milk and other diary products, or meat, the refrigerated product must be maintained at a temperature typically in the range of 28 to 41 degrees F. depending upon the particular refrigerated product. In medium temperature produce display cases for example, conventional practice in the field of commercial refrigeration has been to pass the circulating cooling air over the tubes of an evaporator in which refrigerant passing through the tubes boils at about 21 degrees F. to maintain the cooling air temperature at about 31 or 32 degrees F. In medium temperature dairy product display cases for example, conventional practice in the commercial refrigeration field has been to pass the circulating cooling air over the tubes of an evaporator in which refrigerant passing through the tubes boils at about 21 degrees F. to maintain the cooling air temperature at about 28 or 29 degrees F. In medium temperature meat display cases for example, conventional practice in the commercial refrigeration field has been to pass the circulating cooling air over the tubes of an evaporator in which refrigerant boils at about 15 to 18 degrees F. to maintain the cooling air at a temperature of about 26 degrees F. At these refrigerant temperatures, the outside surface of the tube wall will be at a temperature below the frost point. As frost builds up on the evaporator surface, the performance of the evaporator deteriorates and the free flow of air through the evaporator becomes restricted and in extreme cases halted.

Conventional fin and tube heat exchanger coils used in forced air evaporators in the commercial refrigeration industry characteristically have a low fin density, typically having from 2 to 4 fins per inch. It has been conventional practice in the commercial refrigeration industry to use only heat exchangers of low fin density in evaporators for medium temperature and low temperature applications. This practice arises in anticipation of the buildup of frost of the surface of the evaporator heat exchanger and the desire to extend the period between required defrosting operations. As frost builds up, the effective flow space for air to pass between neighboring fins becomes progressively less and less until, in the extreme, the space is bridged with frost. As a consequence of frost buildup, heat exchanger performance decreases and the flow of adequately refrigerated air to the product display area decreases, thus necessitating activation of the defrost cycle.

Consequently, a conventional medium-temperature refrigerated food display system is customarily equipped with a defrost system that may be selectively or automatically operated to remove the frost formation from the evaporator surface, typically one to four times in a 24-hour period for up to one hundred and ten minutes each cycle. Conventional methods for defrosting evaporators on refrigerated food display systems include passing air over an electric heating element and thence over the evaporator, passing ambient temperature store air over the evaporator, and passing hot refrigerant gas through the refrigerant lines to and through the evaporator. In accord with the latter method, commonly referred to as hot gas defrost, hot gaseous refrigerant from the compressor, typically at a temperature of about 75 to about 120 degrees F., passes through the evaporator, warming the evaporator heat exchanger coil. The latent heat given off by the condensing hot gaseous refrigerant melts the frost off the evaporator. The hot gaseous refrigerant condenses in the frosted evaporator and returns as condensed liquid to an accumulator, rather than directly to the compressor to prevent compressor flooding and possible damage.

Although effective to remove the frost and thereby reestablish proper air flow and evaporator operating conditions, defrosting the evaporator has drawbacks. As the cooling cycle must be interrupted during the defrost period, the product temperature rises during the defrost. Thus, product in the display merchandiser may be repeatedly subject to alternate periods of cooling and warming. Therefore, product temperature in a conventional medium-temperature supermarket merchandiser displaying food products may during the defrost cycle exceed the 41 degree F. temperature limit set by the United States Food and Drug Administration. Also, additional controls must be provided on the refrigeration system to properly sequence defrosting cycles, particularly in stores having multiple refrigerated merchandisers to ensure that all merchandisers are not in defrost cycles simultaneously. According, it would be desirable to operate a refrigerated merchandiser, in particular a medium temperature merchandiser, in a continuous essentially frost-free state without the necessity of employing a defrost cycle.

U.S. Pat. No. 3,577,744, Mercer, discloses a method of operating an open refrigerated display case in which the product zone remains frost-free and in which the evaporator coils remain ice-free. In the disclosed method, a small secondary evaporator unit is utilized to dry ambient air for storage under pressure. The cooled, dehydrated air is then metered into the primary cooling air flow and passed in intimate contact with the surfaces in the product zone. As the air in intimate contact with the surfaces is dehydrated, no frost is formed on the surfaces in the product zone.

U.S. Pat. No. 3,681,896, Velkoff, discloses controlling the formation of frost in heat exchangers, such as evaporators, by applying an electrostatic charge to the air-vapor stream and to water introduced into the stream. The charged water droplets induce coalescence of the water vapor in the air and the charged coalesced vapor and droplets collect on the surface of oppositely charged plates disposed upstream of the heat exchanger coils. Thus, the cooling air passing over the heat exchanger coils is relatively moisture-free and frost formation on the heat exchanger coils does not occur.

U.S. Pat. No. 4,272,969, Schwitzgebel, discloses a refrigerator for maintaining a high humidity, frost-free environment. An additional throttling element, for example a suction-pressure-regulating valve or a capillary pipe, is installed in the return line between the evaporator outlet and the compressor for throttling the flow to maintain the evaporator surface above 0 degrees Centigrade. Additionally, the evaporator surface is sized far bigger than the evaporator surface used in conventional refrigerators of the same refrigerated volume, preferably twice the size of a conventional evaporator, and possibly ten times the size of a conventional evaporator.

SUMMARY OF THE INVENTION

It is an object of this invention to provide a method of operating a refrigerated merchandiser system in a substantially frost-free mode.

In accordance with the one aspect of the invention, there is provided a method of operating a refrigerated merchandiser system including the steps of passing refrigerant through the display case evaporator at a relatively lower temperature during a first refrigeration mode and passing refrigerant through the evaporator at a relatively higher temperature during a second refrigeration mode. The relatively higher temperature is about 2 to about 12 degrees F. warmer than the relatively lower temperature and operation sequences between the first refrigeration mode and the second refrigeration mode. Most advantageously, the relatively lower temperature lies in the range from 24 to 32 degrees F. and the relatively higher temperature lies in the range from 31 to 38 degrees F. In an alternate embodiment of this aspect of the invention, operation sequences from the refrigeration mode to an intermediate temperature refrigeration mode, thence to the second refrigeration mode and then back to the first refrigeration mode. In the intermediate temperature refrigeration mode, refrigerant is passed through the evaporator at a temperature between the relatively lower temperature of the refrigerant during the first refrigeration mode and the relatively higher temperature of the refrigerant during the second refrigeration mode. Most advantageously, the temperature of the refrigerant in the intermediate temperature refrigeration mode lies in the range of about 31 to about 32 degrees F.

In accordance with another aspect of the invention, a method of operating a refrigerated merchandiser system is provided including the steps of setting the evaporator pressure control valve at a first set point pressure for a first refrigeration mode and setting the evaporator pressure control valve at a second set point pressure for a second refrigeration mode, the second set point pressure being, higher than the first set point pressure. Operation sequences between the first refrigeration mode and the second refrigeration mode.

It is a further object of the present invention to provide a refrigerated, medium temperature merchandiser operable in an essentially frost-free mode. In accordance with the apparatus aspect of the present invention, a refrigerated merchandiser system includes a compressor, a condenser, a display case having an evaporator, all connected in a closed refrigerant circuit, an expansion device, an evaporator pressure control device and a controller. The controller maintains the evaporator pressure control valve at a first set point pressure for the refrigerant equivalent to a first refrigerant temperature during a first refrigeration mode and at a second set point pressure for the refrigerant equivalent to a second refrigerant temperature about 2 to about 12 degrees warmer than the first temperature during a second refrigerant mode. The controller sequences operation between the first refrigeration mode and said second refrigeration mode.

DESCRIPTION OF THE DRAWINGS

For a further understanding of the present invention, reference should be made to the following detailed description of a preferred embodiment of the invention taken in conjunction with the accompanying drawings wherein.

DESCRIPTION OF THE PREFERRED EMBODIMENT

For purposes of illustration, the commercial refrigeration system of the present invention is depicted as having a single display case with a single evaporator, a single condenser, and a single compressor. It is to be understood that the principles of the present invention are applicable to various embodiments of commercial refrigeration systems having single or multiple display cases with one or more evaporators per case, single or multiple condensers and/or single or multiple compressor arrangements.

Figure 1:
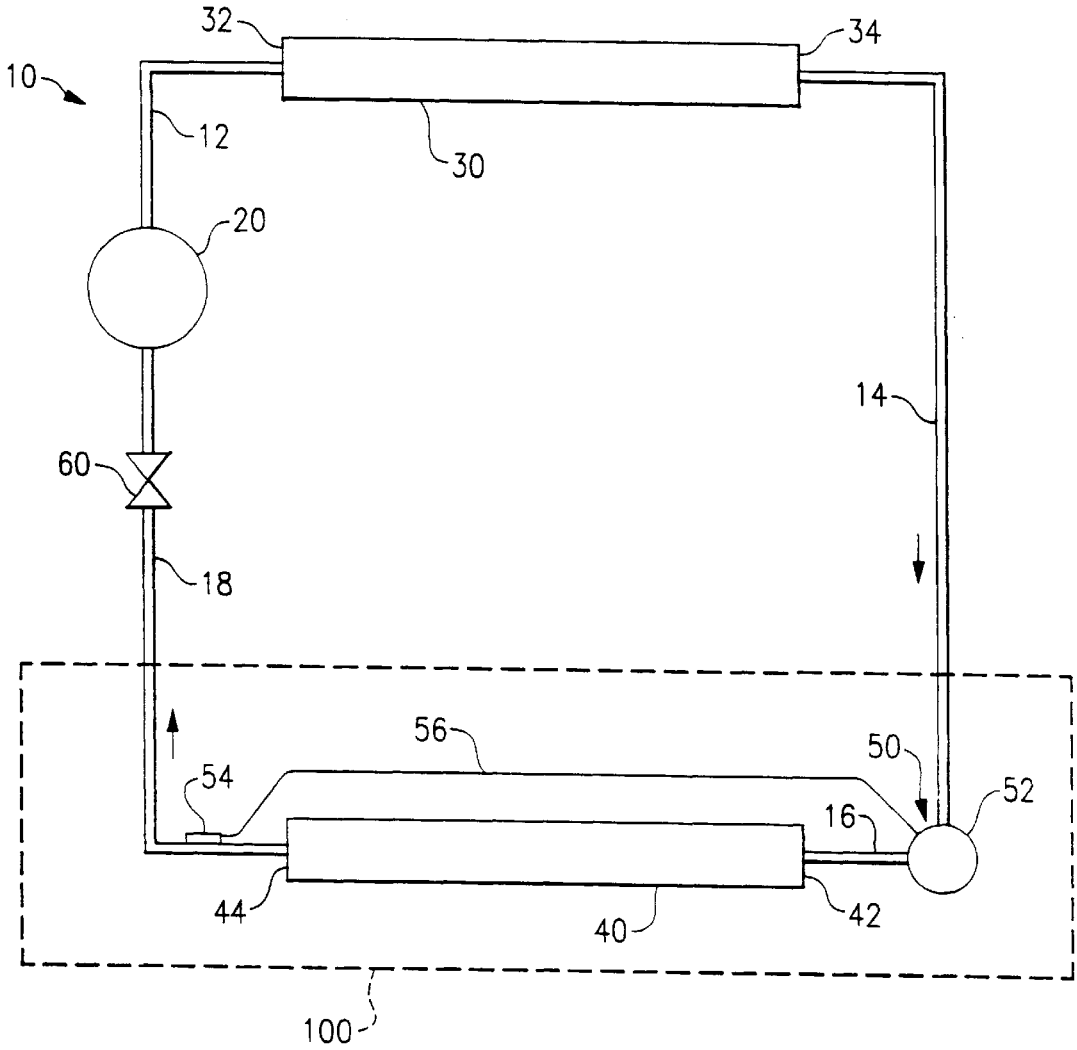
FIG. 1 is a schematic diagram of a commercial refrigeration system using the present invention.
Figure 2:
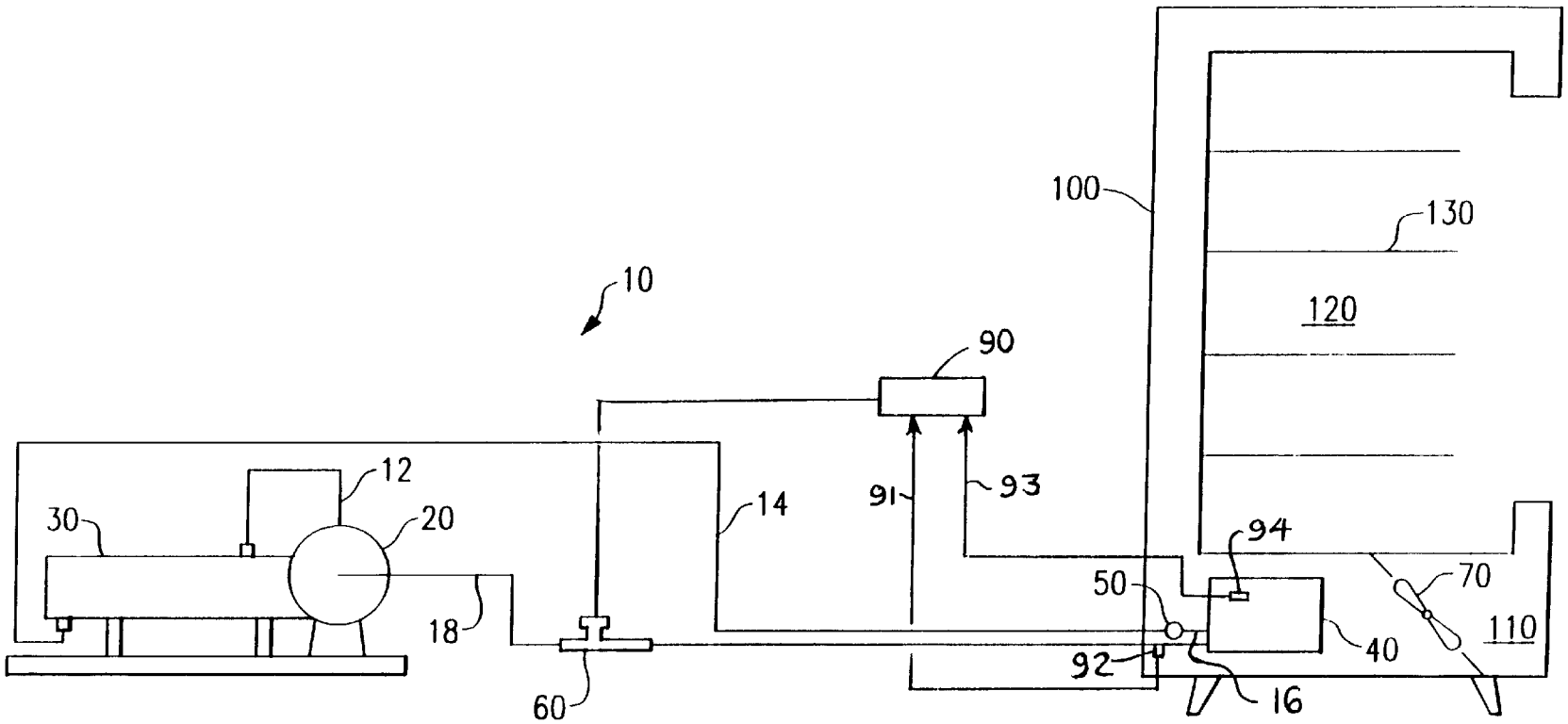
FIG. 2 is an elevation view of a representative layout of the commercial refrigeration system shown schematically in FIG. 1.

Referring now to FIGS. 1 and 2, the refrigerated merchandiser system 10 of the present invention includes five basic components: a compressor 20, a condenser 30, an evaporator 40, an expansion device 50 and an evaporator pressure control device 60 connected in a closed refrigerant circuit via refrigerant lines 12, 14, 16 and 18. Additionally, the system 10 includes a controller 90. It is to be understood, however, that the present invention is applicable to refrigeration systems having additional components, controls and accessories. The outlet or high pressure side of the compressor 20 connects via refrigerant line 12 to the inlet 32 of the condenser 30. The outlet 34 of the condenser 30 connects via refrigerant line 14 to the inlet of the expansion device 50. The outlet of the expansion device 50 connects via refrigerant line 16 to the inlet 42 of the evaporator 40 disposed within the display case 100. The outlet 44 of the evaporator 40 connects via refrigerant line 18, commonly referred to as the suction line, back to the suction or low pressure side of the compressor 20.

The evaporator 40, most advantageously in the form of a fin and tube heat exchanger coil, is disposed within the display case 100 in a compartment 110 separate from and beneath the product display area 120. As in convention practice, air is circulated, either by natural circulation or by means of a fan 70, through the evaporator 40 and thence through the product display area 120 to maintain products stored on the shelves 130 in the product display area 120 at a temperature below the ambient temperature in the region of the store near the display case 100. As the air passes through the evaporator 40, it pass over the external surface of the fin and tube heat exchanger coil in heat exchange relationship with the refrigerant passing through the tubes of the exchanger coil.

Most advantageously, the fin and tube heat exchanger coil of the high efficiency evaporator 40 has a relatively high fin density, that is a fin density of at least 5 fins per inch, and most advantageously in the range of 6 to 15 fins per inch. The relatively high fin density heat exchanger coil of the preferred embodiment of the high efficiency evaporator 40 is capable of operating at a significantly lower differential of refrigerant temperature to evaporator outlet air temperature than the conventional commercial refrigeration low fin density evaporators operate at.

The expansion device 50, which is preferably located within the display case 100 close to the evaporator, may be mounted at any location in the refrigerant line 14, serves to meter the correct amount of liquid refrigerant flow into the evaporator 40. As in conventional practice, the evaporator 40 functions most efficiently when as full of liquid refrigerant as possible without passing liquid refrigerant out of the evaporator into suction line 18. Although any particular form of conventional expansion device may be used, the expansion device 50 most advantageously comprises a thermostatic expansion valve (TXV) 52 having a thermal sensing element, such as a sensing bulb 54 mounted in thermal contact with suction line 18 downstream of the outlet 44 of the evaporator 40. The sensing bulb 54 connects back to the thermostatic expansion valve 52 through a conventional capillary line 56.

The evaporator pressure control device 60, which may comprise a stepper motor controlled suction pressure regulator or any conventional evaporator pressure regulator valve (collectively EPRV), operates to maintain the pressure in the evaporator at a preselected desired operating pressure by modulating the flow of refrigerant leaving the evaporator through the suction line 18. By maintaining the operating pressure in the evaporator at that desired pressure, the temperature of the refrigerant expanding from a liquid to a vapor within the evaporator 40 will be maintained at a specific temperature associated with the particular refrigerant passing through the evaporator.

Therefore, as each particular refrigerant has its own characteristic temperature-pressure curve, it is theoretically possible to provide for frost-free operation of the evaporator 40 by setting EPRV 60 at a predetermined minimum pressure set point for the particular refrigerant in use. In this manner the refrigerant temperature within the evaporator 40 may be effectively maintained at a point at which all external surfaces of the evaporator 40 in contact with the moist air within the refrigerated space are above the frost formation temperature. However, due to structural obstructions or airflow maldistribution over the evaporator coil, some locations on the coil may fall into a frost formation condition leading to the onset of frost formation.

The controller 90 functions to regulate the set point pressure at which the EPRV 60 operates. The controller 90 receives an input signal from at least one sensor operatively associated with the evaporator 40 to sense an operating parameter of the evaporator 40 indicative of the temperature at which the refrigerant is boiling within the evaporator 40. The sensor may comprise a pressure transducer 92 mounted on suction line 18 near the outlet 44 of the evaporator 40 and operative to sense the evaporator outlet pressure. The signal 91 from the pressure transducer 92 is indicative of the operating pressure of the refrigerant within the evaporator 40 and therefore for the given refrigerant being used, is indicative of the temperature at which the refrigerant is boiling within the evaporator 40. Alternatively, the sensor may comprise a temperature sensor 94 mounted on the coil of the evaporator 40 and operative to sense the operating temperature of the outside surface of the evaporator coil. The signal 93 from the temperature sensor 94 is indicative of the operating temperature of the outside surface of the evaporator coil and therefore is also indicative of the temperature at which the refrigerant is boiling within the evaporator 40. Advantageously, both a pressure transducer 92 and a temperature sensor 94 may be installed with input signals being received by the controller 90 from both sensors thereby providing safeguard capability in the event that one of the sensors fails in operation.

The controller 90 determines the actual refrigerant boiling temperature at which the evaporator is operating from the input signal or signals received from sensor 92 and/or sensor 94. After comparing the determined actual refrigerant boiling temperature to the desired operating range for refrigerant boiling temperature, the controller 90 adjusts, as necessary, the set point pressure of the EPRV 60 to maintain the refrigerant boiling temperature at which the evaporator 40 is operating within a desired temperature range. In accordance with the present invention, the controller 90 functions to selectively regulate the set point pressure of the EPRV 60 at a first set point pressure for a first time period and at a second set point pressure for a second time period and to continuously cycle the EPRV 60 between the two set point pressure. The first set point pressure is selected to lie within the range of pressures for the refrigerant in use equivalent at saturation to a refrigerant temperature in the range of 24 degrees F. to 32 degrees F., inclusive. The second set point pressure is selected to lie within the range of pressures for the refrigerant in use equivalent at saturation to a refrigerant temperature in the range of 31 degrees F. to 38 degrees F., inclusive. Therefore, in accordance with the present invention, the refrigerant boiling temperature within the evaporator 40 is always maintained at a refrigerating level, cycling between a first temperature within the range of 24 degrees F. to 32 degrees F. for a first time period and a second slightly higher temperature within the range of 31 degrees F. to 38 degrees F. for a second period. In this cyclic mode of operation, the evaporator 40 operates continuously in a refrigeration mode, while any undesirable localized frost formation that might occur during the first period of operation cycle at the cooler refrigerant boiling temperatures is periodically eliminated during second period of the operating cycle at the warmer refrigerant boiling temperatures. Typically, it is advantageous to maintain the refrigerant boiling, temperature within the evaporator during the second period of an operation cycle at about 2 to about 12 degrees F. above the refrigerant boiling temperature maintained during the first period of the operation cycle.

Although, the respective durations of the first period and the second period of the operation cycle will varying from display case to display case, in general, the first time period will substantially exceed the second time period in duration. For example, a typical first time period for operation at the relatively cooler refrigerant boiling temperature will extend for about two hours up to several days, while a typical second time period for operation at the relatively warmer refrigerant boiling temperature will extend for about fifteen to forty minutes. However, the operator of the refrigeration system may selectively and independently program the controller 90 for any desired duration for the first time period and any desired duration for second time period without departing from the spirit and scope of the present invention.

In transitioning from operation at the relatively cooler refrigerant boiling temperature to continued refrigeration operation at the relatively warmer refrigerant boiling temperature, it may be advantageous to briefly maintain steady-state operation at an intermediate temperature of about 31 to about 32 degrees F. The time period for operation at this intermediate temperature would generally extend for less than about ten minutes, and typically from about four to about eight minutes. Such an intermediate steady-state stage may be desirable, for example on single compressor refrigeration systems, as a means of avoiding excessive compressor cycling. In sequencing back from operation at the relatively warmer refrigerant boiling temperature to operation at the relatively cooler refrigerant boiling temperature, no intermediate steady-state stage is provided.

In addition to being particularly useful in display cases operating in accord with the preventative frost management method of the present invention, the high fin density heat exchanger coil of the preferred embodiment of the high efficiency evaporator 40 is also more compact in volume than conventional commercial refrigeration evaporators of comparable heat exchange capacity. For example the evaporator for the model L6D8 medium-temperature display case manufactured by Tyler Refrigeration Corporation of Niles, Mich., which is designed to operate with a refrigerant temperature of 20 degrees F. It has a fin and tube heat exchanger of conventional design having 10 rows of ⅝ inch diameter tubes having 2.1 fins per inch, providing about 495 square feet of heat transfer surface in a volume of about 8.7 cubic feet. With the high fin density, high efficiency evaporator 40 installed in the model L6D8 case, the display case was successfully operated in a relatively frost-free mode in accordance with the present invention. The high efficiency evaporator operated with a refrigerant temperature of 29 degrees F. In comparison to the aforedescribed conventional heat exchanger, the high fin density heat exchanger of the high efficiency evaporator has 8 rows of ⅜ inch diameter tubes having 10 fins per inch, providing about 1000 square feet of heat transfer area in a volume of about 4.0 cubic feet. Thus, in this application, the high efficiency evaporator 40 provides nominally twice the heat transfer surface area while occupying only half the volume of the conventional evaporator.

Although a preferred embodiment of the present invention has been described and illustrated, other changes will occur to those skilled in the art. It is therefore intended that the scope of the present invention is to be limited only by the scope of the appended claims.

What is claimed is:

1. A method of operating a refrigerated merchandiser system including a display case having an evaporator, comprising:

passing refrigerant through said evaporator at a relatively lower temperature for a first refrigeration operating mode;

passing refrigerant through said evaporator at a relatively higher temperature for a second refrigeration operating mode, the relatively higher being about 2 to about 12 degrees F. warmer than the relatively lower temperature; and sequencing between said first refrigeration mode and said second refrigeration mode.

2. A method as recited in claim 1 wherein the relatively lower temperature lies in the range from 24 to 32 degrees F. and the relatively higher temperature lies in the range from 31 to 38 degrees F.

3. A method as recited in claim 2 wherein said first refrigeration mode is longer than said second refrigeration mode.

4. A method of operating a refrigerated merchandiser system including a display case having an evaporator, a compressor, a condenser, all connected in a refrigeration circuit containing a refrigerant, an expansion device disposed in the refrigeration circuit upstream of and in operative association with the evaporator, and an evaporator pressure control valve disposed in the refrigeration circuit downstream of and in operative association with the evaporator, comprising:

setting the evaporator pressure control valve at a first set point pressure for a first refrigeration operating mode;

setting the evaporator pressure control valve at a second set point pressure for a second refrigeration operating mode, the second set point pressure being higher than the first set point pressure; and sequencing between said first refrigeration mode and said second refrigeration mode.

5. A method as recited in claim 4 wherein said first refrigeration mode is longer than said second refrigeration mode.

6. A method as recited in claim 4 wherein the first set point pressure results in a temperature for the refrigerant in the evaporator lying in the range from 24 to 32 degrees F. and the second set point pressure results in a temperature for the refrigerant lying in the range from 31 to 38 degrees F.

7. A refrigerated medium temperature food merchandiser system having a display case including an evaporator, a compressor, a condenser, and an expansion device upstream of and in operative association with the evaporator, all connected in a refrigeration circuit, characterized by:

an evaporator pressure control valve disposed in the refrigeration circuit downstream of and in operative association with the evaporator, the evaporator pressure control valve having a first set point pressure and a second set point pressure; and a controller operatively associated with the evaporator pressure control valve for maintaining the first set point pressure at a pressure for the refrigerant equivalent to a first refrigerant temperature during a first refrigeration mode, for maintaining the second set point pressure for the refrigerant equivalent to a second refrigerant temperature about 2 to about 12 degrees warmer than the first temperature during a second refrigerant mode, and for sequencing between said first refrigeration mode and said second refrigeration mode.

8. A refrigeration system as recited in claim 7, further characterized in that the first refrigerant temperature lies in the range of 24 to 32 degrees F. and the second refrigerant temperature lies in the of 31 to 38 degrees.

9. A refrigeration system as recited in claim 7, further characterized in that the evaporator has a fin and tube heat exchanger having a fin density in the range of 6 fins per inch to 15 fins per inch.

10. A refrigeration system as recited in claim 9, further characterized in that the first refrigerant temperature lies in the range of 24 to 32 degrees F. and the second refrigerant temperature lies in the of 31 to 38 degrees.

11. A method of operating a refrigerated merchandiser system including a display case having an evaporator, comprising:

passing refrigerant through said evaporator at a relatively lower temperature for a first refrigeration operating mode;

passing refrigerant through said evaporator at a relatively higher temperature for a second refrigeration operating mode, the relatively higher being about 2 to about 12 degrees F. warmer than the relatively lower temperature;

passing refrigerant through said evaporator at an intermediate temperature between the relatively lower temperature and the relatively higher temperature for an intermediate temperature refrigeration mode; and sequencing operation from said first refrigeration mode to said intermediate temperature refrigeration mode to said second refrigeration and thence back to said first refrigeration mode.

12. A method as recited in claim 11 wherein said first refrigeration mode extends for at least about 2 hours, said intermediate temperature refrigeration mode extends for less than about 10 minutes, and said second refrigeration mode extends for about 15 to about 45 minutes.

13. A method as recited in claim 12 wherein said intermediate temperature refrigeration mode extends from about 4 to about 8 minutes.

14. A method as recited in claim 11 wherein the relatively lower temperature lies in the range from 24 to 32 degrees F., the relatively higher temperature lies in the range from 31 to 38 degrees F. and the intermediate temperature lies in the range from 31 to 32 degrees.

15. A method as recited in claim 14 wherein said first refrigeration mode extends for at least about 2 hours, said intermediate temperature refrigeration mode extends for less than about 10 minutes, and said second refrigeration mode extends for about 15 to about 45 minutes.

16. A method as recited in claim 15 wherein said intermediate temperature refrigeration mode extends from about 4 to about 8 minutes.

* * * * *